United States Patent [19]

Brunold et al.

[11] Patent Number: 4,832,500

[45] Date of Patent: May 23, 1989

[54] MIXING APPARATUS AND PROCESSES

[75] Inventors: Colin R. Brunold, Surrey; Andrew W. Dickens, West Midlands, both of England; Jeremy C. B. Hunns, Swansea, Wales; Malcolm R. Mackley, Cambridge; Huw R. Williams, London, both of England

[73] Assignee: National Research Development Corporation, London, England

[21] Appl. No.: 6,715

[22] PCT Filed: Jun. 26, 1986

[86] PCT No.: PCT/GB86/00375

§ 371 Date: Feb. 2, 1987

§ 102(e) Date: Feb. 2, 1987

[87] PCT Pub. No.: WO87/00079

PCT Pub. Date: Jan. 15, 1987

[30] Foreign Application Priority Data

Jun. 28, 1985 [GB] United Kingdom ..... 8516344

[51] Int. Cl.[4] ..... B01F 5/12

[52] U.S. Cl. ..... 366/268; 366/332; 366/337; 366/339; 366/340; 366/243; 138/37; 138/39

[58] Field of Search ..... 366/336, 337, 338, 339, 366/340, 349, 332, 333, 334, 262, 267, 268, 269, 256, 154, 164, 176, 194, 243, 244, 255, 257; 210/738, 199, 205; 138/44, 42, 37, 31, 39

[56] References Cited

U.S. PATENT DOCUMENTS

| | | | |
|---|---|---|---|
| 2,029,688 | 2/1936 | Wilson | 366/176 X |
| 2,667,407 | 1/1954 | Fenske | 366/332 X |
| 2,828,111 | 3/1958 | Messinger et al. | 366/96 |
| 3,330,535 | 7/1967 | Stenger | 366/147 |
| 3,531,093 | 9/1970 | Karpacheva et al. | 366/165 |
| 3,804,376 | 4/1974 | Clasen | 366/176 |
| 3,855,368 | 12/1974 | Prochazka | 366/332 X |
| 3,910,563 | 10/1975 | Vissers | 366/57 |
| 3,934,614 | 1/1976 | Elek | 138/44 |
| 3,975,171 | 8/1976 | Burnham, Sr. | 366/262 X |
| 4,000,086 | 12/1976 | Stoev et al. | 366/176 |
| 4,259,024 | 3/1981 | Clasen et al. | 366/339 |
| 4,350,650 | 9/1982 | Cereghini | 366/267 X |

FOREIGN PATENT DOCUMENTS

| | | |
|---|---|---|
| 2525229 | 12/1976 | Fed. Rep. of Germany . |
| 556944 | 7/1923 | France . |
| 1195160 | 11/1959 | France . |
| 2054487 | 4/1971 | France . |
| 2446666 | 8/1980 | France . |
| 590998 | 8/1947 | United Kingdom . |
| 624207 | 5/1949 | United Kingdom . |
| 682946 | 11/1952 | United Kingdom . |
| 1442754 | 7/1976 | United Kingdom . |

*Primary Examiner*—Harvey C. Hornsby
*Assistant Examiner*—K. L. O'Leary
*Attorney, Agent, or Firm*—Nixon & Vanderhye

[57] ABSTRACT

Apparatus for mixing or otherwise agitating fluid material comprises an elongated vessel (1) to contain the material, means (6, 7, 9, 10) to impose oscillatory motion upon the material in a lengthwise direction, and a plurality of stationary obstacles (19, 35) mounted on the inner wall (2) of the vessel and arranged in sequence lengthwise. The obstacles present sharp ridge-form tips (20, 37) each ridge pointing in a direction (30) at right angles to that of the oscillating motion. Each adjacent pair of obstacles and the length of vessel wall between them define a trough-shaped space (26) in which the oscillating motion repeatedly forms vortices and then ejects those vortices vigorously into the remainder of the fluid outside the trough, so promoting the agitation of that fluid. The invention applies particularly to cylindrical vessels in which the obstacles are ring-shaped (19) or are constituted by the successive turns of a helix (35). A steady longitudinal motion of the fluid through such a vessel may be imposed upon the oscillatory one; also the means to introduce two fluids separately at one end of such a vessel and withdraw them as a mixture from the other end. The specification teaches conditions that should be observed in order to promote uniformity of residence time of the fluid contents when the apparatus is used thus.

21 Claims, 2 Drawing Sheets

MIXING APPARATUS AND PROCESSES

This invention relates to what will be referred to, generally, as mixing apparatus and processes. More specifically, within that general definition, the invention relates to reactor and other vessels where a system of two or more phases must be kept in suspension: this includes solid/liquid systems where particles under normal conditions would sediment upwards or downwards, liquid/liquid systems of immiscible fluids that must be maintained in uniform suspension, and liquid/-gas systems in which it is desired to mix the gas bubbles with the liquid as uniformly as possible to maximise mass transfer effects. The invention also finds particular application to vessels in which it is desired to maximise heat and mass transfer between the vessel walls and the fluid within the vessel. The invention finds further particular application to vessels in which it is desired to maximise the "surface purging" effect exercised upon the walls of the vessel by the liquid within it, thereby keeping those walls as free as possible from fouling or the accumulation of any solid material. This aspect of the invention could be particularly important in relation to tubular filtration and ultrafiltration equipment.

While the invention is therefore applicable to the agitation of a unitary fluid mass, and to some batch processes and to the apparatus for carrying them out, it is however specially applicable to continuous processes in which two or more constitutents enter an elongated reactor vessel separately at one end and are required to achieve "near plug flow" through the vessel before leaving it at the other end. That is to say, the residence time—which may be long, measured in hours or even days—of all the constituents within the vessel must be as uniform as possible.

The invention arises from appreciating that by imposing the oscillating motion—in addition to any steady motion that may also be present—upon fluent material contained within a vessel, so that that material is caused to cross and re-cross stationary obstacles of a particular kind, mixing of an unexpectedly vigorous kind is effected.

The invention is to be contrasted with the kind of apparatus and processes described, for example, in UK Pat. No. 1442754 and corresponding U.S. Pat. No. 4,075,091. In the preferred apparatus described in those specifications, blood is pumped from end to end down a long tubular conduit the wall of which is of gently-undulating or "furrowed" configuration, and a longitudinal pulsating velocity is superimposed upon the basic longitudinal flow of the blood. The result of this combination of geometry and motion is said to be the repeated generation, within each successive "furrow" of the inner wall of the conduit, of vortices the axes of which lie transverse to the general direction of flow. Without creating turbulence which could be harmful to the blood, such vortices promote vigorous transfer of gas to or from the blood across the vessel wall, if that wall is made of appropriate and permeable material. The apparatus therefore has potential uses as a blood oxygenator or dialyser. If the chamber walls are of metal instead of being permeable, such apparatus can promote good heat transfer between the media within and outside the vessel, as the specification also suggests. However the claims and indeed the general teaching of such patents are confined to apparatus by which heat or mass transfer may be effected, through the vessel wall, between blood within and some other medium outside. Where blood is the fluid being treated there are special reasons for ensuring that the vortices, however vigorous, are confined to the furrows, leaving the main part of the blood flow through the unobstructed central part of the bore of the conduit relatively undisturbed. The present invention arises from appreciating the potential of apparatus with some similarities, but also with the important difference that the gentle undulations are replaced by obstacles of a quite different character, leading to mixing which affects the entire fluid content of the vessel and is of a vigour that could be unsuitable for blood.

The invention is also to be contrasted with the kind of apparatus and process, of which German OLS DT No. 2525229 A1 (Brauer) and British GB No. 682946 B1 (Muller) provide examples, in which mixing of the fluid contents of a vessel is promoted by causing them to flow back and forth through orifices, sometimes sharp-edged, formed in moving or stationary baffles. While the edges of such orifices may be regarded as obstacles for the fluid to encounter, their geometry is different from that of the present invention. Furthermore the smallness of the aperture of such orifices, compared with the area of the baffles in which they are formed, is also different from what the present invention requires.

Mixing apparatus according to the invention comprises a vessel for containing fluent material; means for imposing on the contained material an oscillatory motion in a predetermined direction; and a plurality of stationary obstacles located within the vessel in sequence parallel to the direction of oscillation, the obstacles presenting sharp extremities at which two surfaces meet at a ridge so that the plane lying symmetrically midway between the two ridge-forming surfaces lies substantially at right angles to the direction of the oscillation, and in which the depth of the clear space lying proud of the ridge of each obstacle and available for the material within the vessel, when measured in a direction transverse to that of the oscillatory motion, substantially exceeds the depth of the obstacle itself when similarly measured.

The obstacles may be mounted on the inner wall of the vessel, the vessel may be of cylindrical shape, and the obstacles may be located sequentially along the length of the vessel.

The vessel may be elongated and the oscillatory flow may be induced by a piston or pistons located so as to constitute the end wall or walls of the vessel.

The obstacles may be in the forms of rings with sharp innermost extremities. Alternatively the obstacles may be presented by a thin strip formed into a helix coaxial with the vessel, one long edge of the strip being fixed to the inner wall of the vessel, so that the ridges are presented by the opposite long edge, whereby successive complete turns of the helix constitute successive obstacles.

The longitudinal spacing between adjacent rings, and the axial distance taken up by a 360° turn of the helix, may be of the order of 0.5 to 3 times the internal diameter A of the vessel, particularly 1.5 times.

The diameter of the unobstructed central cylindrical space within the vessel, lying radially-inboard of the ridges of the obstacles, may be of the order of say 0.5 to 0.86 times the diameter A of the vessel, particularly about 0.7 times.

The ratio $x_o/A$ may exceed 1/30 and may typically lie between 1/20 and 1/5, here $x_o$ is the amplitude of oscillation.

There may also be inlet means to admit at least one material to one end of the vessel, to impose a unidirectional motion upon material within the vessel in the same direction as the oscillatory motion, and outlet means to release it from the other end of the vessel after mixing, and the inlet means may separately admit at least two materials to the first end of the vessel.

The invention also includes a method of mixing at least two materials, using such apparatus, in which the value of the amplitude of oscillation is substantially that which causes the value of the quantity D/uL to be a minimum, where L is the axial length of the vessel, u is the mean velocity of the fluid as it flows through the vessel from the inlet means to the outlet means, and D is the axial dispersion coefficient of the flow. Where the fluent material contains particles, the maximum velocity of the oscillatory motion may be not less than the terminal velocity of the particles.

The Reynolds number Re of the oscillatory motion set up between adjacent obstacles is desirably above 100 and preferably in the range 200–300 or above, and where a unidirectional motion through the vessel is superimposed on the essential oscillatory one the Reynolds number of the unidirectional flow is preferably less than the peak Reynolds number of the oscillatory motion.

The invention is also defined by the claims and the invention will now be described, by way of example, with reference to the accompanying drawings in which:

Figure 1:
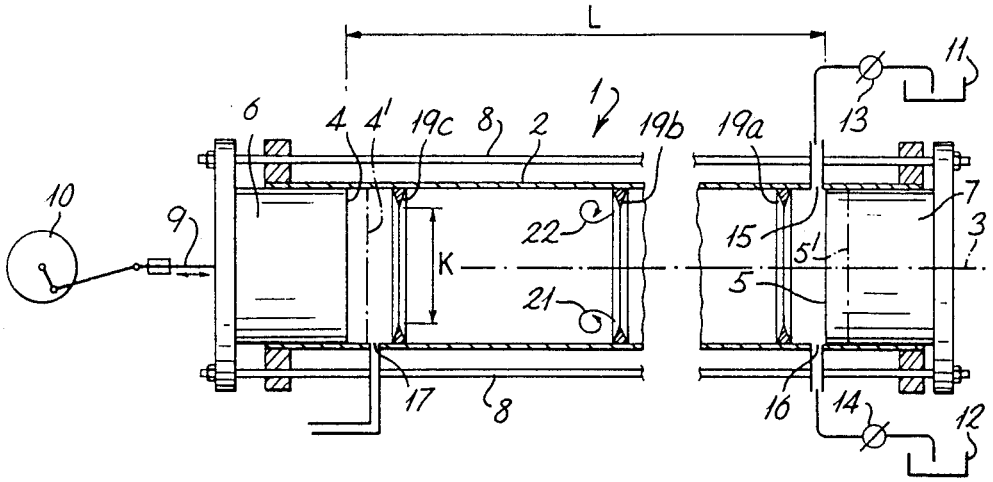
FIG. 1 is a diagrammatic longitudinal section through one apparatus at one stage in a cycle of its operation.

The apparatus of FIG. 1 includes a mixing vesel 1 comprising a cylindrical body 2, the axis of which is indicated by the line 3, and end faces 4 and 5 presented by pistons 6 and 7 which constitute means for imposing oscillatory motion on the contents of the vessel. Pistons 6 and 7 are mounted to seal against but also slide within the cylinder and are connected by a frame 8 and operating rod 9 to a reciprocating motor 10.

First and second fluent materials are drawn from reservoirs 11 and 12 by metering pumps 13 and 14 (which may be of peristaltic type) respectively and pumped into the vessel 1 in steady flow by way of inlet ports 15 and 16 respectively. The steady action of pumps 13 and 14 imposes on the two fluids, once within the vessel, a steady leftwards motion until they leave it by way of outlet port 17. This steady motion is superimposed on the oscillating one as motor 10 moves the pistons 6 and 7 to and fro between the positions in which they are shown in full lines, and the postions in which they are shown in broken lines, when the faces defining the end walls of the vessel are in positions 4' and 5'.

Obstacles in the form of a sequence of triangular-section rings 19 with sharp, inward facing ridge-form tips 20 are mounted at regular intervals down the length of vessel 1. Three such rings indicated by references 19*a, b* and *c* are shown in FIG. 1. The vital vortex creating and shedding effect of the oscillating movement of pistons 6 and 7 is illustrated in outline in FIG. 4. Towards the end of a leftwards (as illustrated) motion (28) of the pistons an anti-clockwise vortex or eddy 21 is generated immediately to the lee side of the ring 19*a* in section (i) of FIG. 4. Section (ii) of FIG. 4, which also includes the adjacent ring 19*b*, shows what happens when the oscillatory movement of the pistons 6 and 7 reverses as indicated by arrow 29. A strong flow 25, close to the wall of the body 2, is set up in the "trough" or "furrow" 26 bounded by the body wall and the confronting faces 27 of the adjacent rings 19*a* and 19*b*. This flow seeks the natural gap between that wall and the local vortex 21 generated at ring 19*a* during the previous leftwards phase of the oscillating movement. Finally, as section (iii) of FIG. 4 indicates, as the rightwards oscillatory phase continues the flow 25 lifts or sheds the vortex 21 clear of the ring 19*a* where it was generated, and propels it towards the vessel axis 3 and the other side of the vessel. At the same time the start of the next half-cycle of the oscillatory movement is signalled by the formation of a clockwise vortex 21*a* in trough 26*a* immediately to the right hand side of ring 19*a*.

Figure 2:
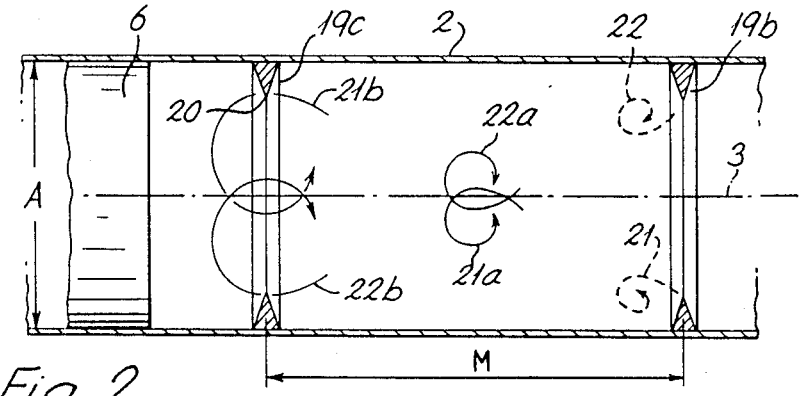
FIG. 2 is a section through the same apparatus at a subsequent stage in the cycle.
Figure 4:
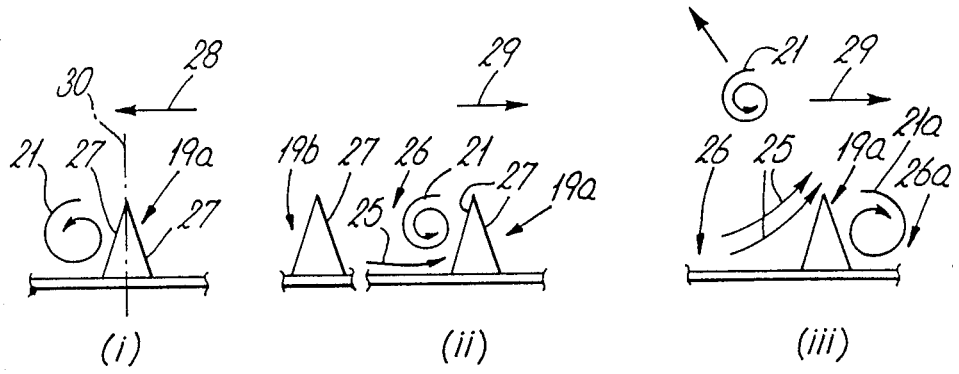
FIG. 4 illustrates in detail the formation and movement of vortices in the apparatus of FIG. 1.

The effect of such vortex generation, in the context of the apparatus taken as a whole, is illustrated in FIG. 2. the generation of vortices around the whole inner circumference of body 2, to the left-hand side of ring 19*a* as shown in FIG. 4(*i*), is indicated at 21 and 22. As indicated in FIG. 2, given the appropriate combination of dimensions and operating characteristics, the following reverse stroke of the pistons, which is in opposition to the steady motion of the fluids set up by pumps 13 and 14, tends to throw the eddies 21 and 22 towards and then across the axis 3 of the vessel, so that they move in succession to the positions indicated by references 21*a*, 22*a* and 21*b*, 22*b*. Thus eddies 21 and 22 originally set up on opposite sides of the vessel axis are thrown towards each other, mix and separate again, promoting thorough mixing of the two fluid constituents, such mixing being repeated at each succeeding device 19. Such mixing is not only repeated by a fresh separation at each succeeding obstacle 19 but is also enhanced by the eddies 21 and 22, generated at one obstacle 19, colliding with the sharp ridge 20 of the next one and there re-separating. In the absence of the oscillatory component of motion contributed by pistons 6 and 7, the flow of the combined fluids through the vessel 1 would be essentially of laminar type, and the residence time distribution of fluid particles within the vessel would have the wide spread that is characteristic of such flow. The combination of the oscillatory component of motion and the sharp-pointed obstacles 19 results in the generation of eddies and their subsequent diametrical movement across the bore of the vessel, as just described. This prevents the formation of the typical laminar flow velocity profile, creating instead of a profile more akin to that of "plug flow". The residence time distribution of fluid particles is therefore different, the standard deviation from the mean residence time being much smaller than before, with obvious potential benefits, for example, for mixing processes in which accurate control of the time in which the ingredients are in contact is essential to prevent excessive or insufficient chemical reaction between them.

The pattern of the generation and transport of the eddies or vortices, just described, is central to the present invention, and it appears that this pattern depends critically upon the shape of the obstacles exemplified by the rings 19. They must be pointed, and where the tip of the obstacles is formed by two simple surfaces meeting at the ridge at an apparent angle, as in FIGS. 1, 2 and 4, the direction of the point is indicated as shown in FIG. 4(*i*) by the bisector 30 of the angle between the two sloping faces 27 of the ring 19. More generally, the direction of the point of the ridge can be indicated by a plane lying symmetrically midway between the two surfaces that form the ridge. The direction in which the ridge points must lie substantially at right angles to the direction of the oscillatory flow (that is to say, the common line of arrows 28 and 29).

It also appears that the quantities A the inner diameter of the body 2, $x_o$ the maximum amplitude of oscillation of the pistons 6 and 7 and r the radius of curvature at the ridge or tip (20) of each ring or other obstacle may all be significant. The quantity $x_o$ should typically be greater than A/30, and for plug flow characteristics $x_o$ typically lies between A/20 and A/5. In one experiment with a cylindrical body as shown in FIG. 1, and of diameter A equal to 20 mm, near plug flow was obtained at $x_o=1$ mm, i.e. A/20. It also appears that the necessary generation and transport of eddies 21 and 22 is most likely to occur when the function $x_o/r$ has a value above unity, and preferably above 10. This latter requirement is of course unlikely to present a problem where, as with the rings 19 of FIG. 1, the ridge point 20 of the obstacle is presented by an obvious discontinuity where two surfaces meet at an angle, preferably an acute angle of about 10° or less, because in such cases the radius of curvature at the points will naturally be small and can easily be made even smaller by accurate manfuacture. However a small value of r can also be achieved in other ways, as for instance in the embodiment of the invention shown in FIG. 3 in which the many and separate rings 19 of FIG. 1 are replaced by a single and continuous helical strip or strake 35 running the length of the inner wall of the cylindrical body 2. One edge 36 of the strip is welded or otherwise fixed to the body wall throughout its length. The opposite edge 37 of the strip therefore constitutes the essential sharp ridge which the invention requires, and an acceptably low value of the quantity r is obtained either by making the strip 35 very thin, or by sharpening the edges 37, or by a combination of both expedients, and the direction in which the ridge points at any location along the length of the strip may be defined as lying within a plane lying midway between the parallel planes in which the two surfaces of the strip lie at that location. This midway plane must lie substantially at right angles to the direction of the oscillatory motion.

Another factor relevant to satisfactory performance according to the invention is that the peak Reynolds number existing within each "trough" 26 as described with reference to FIG. 4 should be above 100 and preferably in or above the range 200–300 to support the pattern of flow 25, vortex generation and transport illustrated in that Figure. Reynolds number $Re=\rho V_{max}K/\mu$ where $\rho$ is the fluid density, $V_{max}$ is the maximum oscillatory velocity and equals $x_o$ for a sinusoidal oscillation $x=x_o\sin\omega t$, $\mu$ is the fluid viscosity and K is a characteristic dimension of each trough 26. In FIG. 1, K is the diameter of the circular locus of the ridge 20 of each ring 19, and in FIG. 3 it is the diameter of the cylindrical locus of the inner edge 37 of strip 35.

In one test using apparatus as shown in FIGS. 1 and 2 the values of the quantities just discussed were as follows:

$K=20$ mm. $\rho=10^3$ kg/m$^3$.$\mu=10^{-3}$ Ns/m$^2$.
$Re=300$.

The quantity $V_{max}$ was therefore 0.015 m/s. A value of 15 radians/s was chosen for $\omega$, which assuming a value of 1 mm for $x_o$ would have indicated an oscillation frequency of $\omega/2\pi=2.38$ Hz. In fact, a 5 Hz frequency was used.

In another test using apparatus as shown in FIGS. 1 and 2 the following dimensions and operating perameters were chosen:

| | | | |
|---|---|---|---|
| vessel: | length | 0.67 | m |
| | internal diameter | 0.023 | m |
| rings | number | 19 | |
| | internal diameter | 0.013 | m |
| | external diameter | 0.023 | m |
| | thickness (axial dimension) at external diameter | 0.005 | m |
| | angle of sharp inner edge | 45° | |
| | lengthwise spacing between adjacent rings | 0.03 | m |
| flow rate of liquid through vessel | | 2 ± 0.1 | ml/s |
| laminar flow Reynolds Number (based on vessel diameter) | | 110 | |
| Amplitude of oscillation ($x_o$) | | 0.001 | m |

and here again it was found that low frequencies of oscillation, for instance within the range 0.1–20 Hz and especially about 3.5 Hz, could be expected to promote the best mixing and best approximation to plug flow.

Figure 3:
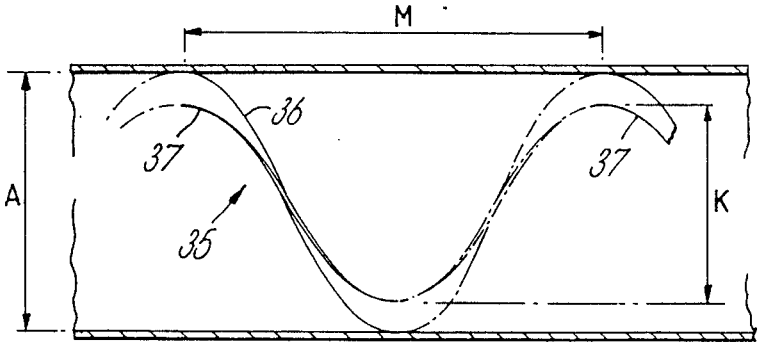
FIG. 3 is a section through the vessel of another apparatus.

As to the longitudinal spacing M between the obstacles 19, and the number of those obstacles, tests suggest a spacing in the range 0.5A–3A, preferably about 3A/2, and that the best results are obtained by including as many obstacles within the vessel as that spacing will allow. In FIGS. 3 M represents instead the axial distance taken up by one complete turn of the helical strip 35. If M is much less or greater than the value just suggested, performance appears to fall off. If the obstacles are closer, flow and effective mixing tend to be confined to the part of the vessel closest to the axis, and stagnant volumes tend to form between adjacent obstacles and close to the vessel wall. If the obstacles are further apart, separation tends to occur at the sharp tip or ridge of each obstacle but the resulting eddies, although they may tend to move diametrically across the bore of the vessel as they move down it, will nevertheless have tended to decay before they encounter the sharp edge of the next obstacle. Good mixing is promoted by such eddies travelling diametrically across the bore of the vessel and meeting the sharp edge of the next obstacle while they are still vigorous. Another significant dimension, in apparatus as illustrated in FIGS. 1 to 3, is the diameter of the unobstructed central region of the vessel that lies radially inboard of the sharp tips of the rings 19 or helical strip 35: that is to say, the quantity K already referred to. There are indications that good performance according to the invention is promoted by providing that the depth of the free space available for fluid and lying proud of the obstacle tips substantially exceeds the depth of the obstacles themselves (and thus of the furrows between obstacles), both depths being measured in a plane transverse to the oscillating motion. In the second of the two experiments already described K represented the free space depth, and (A–K)/2 the obstacle depth. In that experiment the ratio of K to the inner diameter A of the body 2 was 13/23—0.565, and therefore free space depth exceeded obstacle depth by a factor of 13/5. Further tests have suggested that the ratio K/A should lie within the range 0.50–0.86, with a preferred value of about 0.70.

Figure 5:
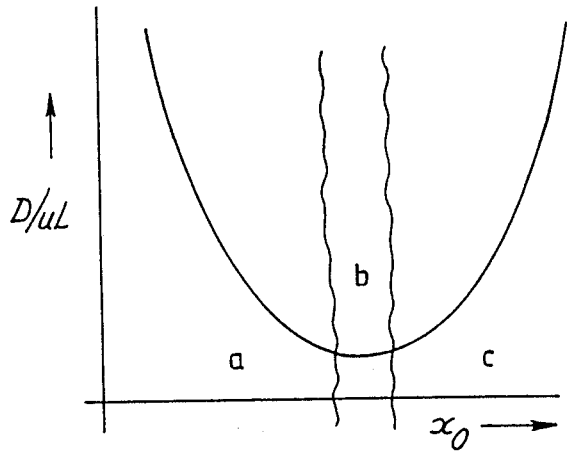
FIG. 5 is a graph.

Tests have also indicated that the quantity D/uL is significant where L is the length of the vessel, u is the mean velocity of the flow and D is the axial dispersion coefficient of the flow. Where a through flow is superimposed on the essential oscillating flow, as will be the case when the apparatus of FIGS. 1 and 2 is used, it is found that particularly good mixing tends to result when the amplitude of oscillation is chosen so that substantially the minimum value of D/uL is achieved: this value is found to coincide with the low values of the variance of the mean residence time of all elements of the two materials within the vessel, and hence with the closest approximation to "plug flow" of the materials through the vessel, that is to say a type of flow combining optimum radial mixing with minimum axial diffusivity. FIG. 5 illustrates a typical pattern of mutual variation of $x_o$ and D/uL. The characteristics of operating according to the invention in the central region b are good mixing, no radial concentration profile and low axial dispersion; in other words, near plug flow. In region a, where the value of $x_o$ is below the optimum, there is likely to be poor mixing, and a radial concentration profile due to the radial velocity profile associated with laminar flow. In the remaining region c, where the value of $x_o$ is above the optimum, there may be good mixing but there will be high axial dispersion and therefore plug flow will be lost. The high oscillation amplitude will also of course tend to result in high power consumption.

While it has been described with reference to processes in which a steady through flow is imposed upon the essential oscillating flow it is important, as the opening paragraph of this specification indicated, to appreciate that the invention includes applications in which the only motion is the oscillating one. Furthermore, while the examples have shown vessels which will be completely full of fluent material during use, the invention also applies to reservoir-like and other open vessels in which the obstacles are located on the floor or walls of the vessel below the surface of the fluent material being treated, and to closed vessels (for instance as shown in FIG. 1 to 3) but operated less than completely full.

We claim:

1. Mixing apparatus, comprising:

a cylindrical vessel having an internal diameter A and a lengthwise axis, said vessel comprising opposite first and second ends and having an inner wall and at least one inlet and at least one outlet, said at least one inlet being confined to one of said ends of said vessel and said at least one outlet being confined to the other of said ends of said vessel, whereby said length of said vessel separates any said inlet from any said outlet; spaced obstacle means for presenting an annular outline when viewed along said lengthwise axis, said obstacle means being mounted on said inner wall of said vessel and presenting at the inner edge of said annular outline means for generating eddy flow, said means comprising sharp extremities at which two surfaces meet at a ridge, said obstacle means being stationary relative to said vessel;

first means for connection to said at least one inlet and for propelling fluent material through said length of said vessel between said at least one inlet and said at least one outlet in steady flow;

second means for imposing on said fluent material a component of oscillatory flow in addition to said steady flow, said second means being separate from and capable of executing oscillatory motion relative to said obstacle means;

said ridge of each of said obstacle means having a clear space lying proud of said ridge, said inner edge of said annular outline defining the periphery of a second of said clear space, said clear space being available for flow of said fluent material through said vessel, said clear space having an area, when viewed along said lengthwise axis of said vessel, which substantially exceeds the area of said annular outline of said obstacle means when similarly viewed.

2. Mixing apparatus according to claim 1 in which said second means comprises at least one piston located so as to constitute at least one end wall of said vessel.

3. Mixing apparatus according to claim 1 in which said obstacle means are located sequentially along the length of said vessel.

4. Mixing apparatus according to claim 3 in which said obstacle means are in the form of rings with sharp innermost extremities.

5. Mixing apparatus according to claim 4 in which the longitudinal spacing (M) between adjacent rings is of the order of 0.5 to 3 times the internal diameter of the vessel.

6. Mixing apparatus according to claim 5 in which the longitudinal spacing (M) is 1.5 times the internal diameter of the vessel.

7. Mixing apparatus according to claim 4 in which the diameter (K) of an unobstructed central cylinder space within said vessel, lying radially-inboard of the ridges of the obstacle means is of the order of 0.5 to 0.86 times the diameter of the vessel.

8. Mixing apparatus according to claim 7 wherein the diameter (K) is of the order 0.7 times the diameter of the vessel.

9. Mixing apparatus according to claim 3 in which said obstacle means are presented by a thin strip formed into a helix coaxial with said vessel, one long edge of said strip being fixed to said inner wall of said vessel, so that each said ridge is presented by the opposite long edge, whereby successive complete turns of said helix constitute successive obstacle means.

10. Mixing apparatus according to claim 9 in which the axial distance (M) taken up by a 360° turn of the helix is of the order of 0.5 to 3 times the internal diameter of the vessel.

11. Mixing apparatus according to claim in which the axial distance (M) is 1.5 times the internal diameter of the vessel.

12. Mixing apparatus according to claim 9 in which the diameter (K) of an unobstructed central cylindrical space within the vessel, lying radially-inboard of the ridges of the obstacles, is of the order of 0.5 to 0.86 times the diameter of the vessel.

13. Mixing apparatus according to claim 12 in which the diameter (K) is of the order of 0.7 times the diameter of the vessel.

14. Mixing apparatus according to claim 3 in which the ratio $x_o/A$ exceeds 1/30, where $x_o$ is the amplitude of oscillatory motion imposed by said second means and A is the internal diameter of said vessel.

15. Mixing apparatus according to claim 14 in which the ratio $x_o/A$ lies within the range 1/20–1/5.

16. Mixing apparatus according to claim 1 including inlets for separately admitting at least materials to said one of said ends of said vessel.

17. A method of mixing at least two materials, said method comprising:

providing a mixing apparatus comprising a cylindrical vessel having a diameter A and a lengthwise axis, said vessel comprising opposite first and second ends and having an inner wall, inlets for separately admitting at least two materials only to said first end of said vessel, and at least one outlet confined to said second end of said vessel for allowing materials to leave said vessel by way of said second end only, spaced obstacle means for presenting an annular outline when viewed in elevation along said lengthwise axis, said obstacle means being mounted on said inner wall and presenting at the inner edge of said annular outline means for generating eddy flow, said means comprising sharp extremities at which two surfaces meet at a ridge, first means for connection to said inlets and for propelling fluent materials through said vessel between said inlets and said at least one outlet in steady flow, and second means for imposing on said fluent material a component of oscillatory flow in addition to said steady flow, said second means being separate from and capable of executing oscillatory motion relative to said obstacle means, each said ridge of each of said obstacle means having a clear space lying proud of said ridge, said inner edge of said annular outline defining the periphery of a section of said clear space, said clear space being available for the flow of said fluid material through said vessel, said clear space having an area, when viewed along said lengthwise axis of said vessel, which substantially exceeds the area of said annular outline of said obstacle means when similarly viewed;

introducing at least two materials into said inlets to mix said at least two materials, the value of the amplitude of oscillation being substantially that which causes the value of a quantity D/uL to be a minimum, where L is the axial length of said vessel, u is the mean velocity of said fluent materials as they pass through said vessel from said inlet to said at least one outlet, and D is the axial dispersion coefficient of the flow of said at least two fluent materials; and causing said at least two materials when mixed to leave said vessel by way of said at least one outlet.

18. A method of mixing at least one particle-containing fluent material, said method comprising:

providing a mixing apparatus comprising a cylindrical vessel having a diameter A and a lengthwise axis, said vessel comprising opposite first and second ends and having an inner wall and at least one inlet for admitting material to said first end of said vessel only and at least one outlet for allowing material to leave said vessel by way of said second end only, spaced obstacle means presenting an annular outline when viewed in elevation along said lengthwise axis, said obstacle means being mounted on said inner wall of said vessel and presenting at the inner edge of said annular outline means for generating eddy flow, said means comprising sharp extremities at which two surfaces meet at a ridge, first means for connection to said at least one inlet and for propelling fluent materials through said vessel between said at least one inlet and said at least one outlet in steady flow, and second means for imposing on said fluent material a component of oscillatory flow in addition to said steady flow, said second means being separate from and capable of executing oscillatory motion relative to said obstacle means, each ridge of said obstacle means having a clear space lying proud of said ridge, said inner edge of said annular outline defining the periphery of a section of said clear space, said clear space being available for the flow of said fluent material through said vessel, said clear space having an area, when viewed along said lengthwise axis of said vessel, which substantially exceeds the area of said annular outline of said obstacle means when similarly viewed; and introducing said at least one particle-containing fluent material through said at least one inlet to mix said at least one particle-containing fluent material, the maximum velocity of said oscillatory motion being not less than the terminal velocity of the particles.

19. A method of mixing at least one material, said method comprising:

providing a mixing apparatus comprising a cylindrical vessel having a diameter A and a lengthwise axis, said vessel comprising opposite first and second ends and having an inner wall and at least one inlet and at least one outlet, said at least one inlet being confined to one of said ends of said vessel for admitting said material only to said first end of said vessel, and said at least one outlet being confined to the other of said ends of said vessel for allowing said material to leave said vessel only by way of said second end, spaced obstacle means for presenting an annular outline when viewed in elevation along said lengthwise axis, said obstacle means being mounted on said inner wall of said vessel and presenting at the inner edge of said annular outline means for generating eddy flow, said means comprising sharp extremities at which two surfaces meet at a ridge, first means for connection to said at least one inlet and for propelling fluent materials through said vessel between said at least one inlet and said at least one outlet in steady flow, and second means for imposing on said fluent material a component of oscillatory flow in addition to said steady flow, said second means being separate from and capable of executing oscillatory motion relative to said obstacle means, each ridge of said obstacle means having a clear space lying between said ridge and said lengthwise vessel axis, said inner edge of said annular outline defining the periphery of a section of said clear space, said clear space being available for the flow of said fluent materials through said vessel, said clear space having an area, when viewed along said lengthwise axis of said vessel, which substantially exceeds the area of said annular outline of said obstacle means which similarly viewed; and introducing said at least one material through said at least one inlet to mix said at least one material, the Reynolds number Re of said oscillatory motion set up between sequentially-adjacent obstacle means being above 100.

20. A method according to claim 19, wherein said Reynolds number Re is in the range of 200–300 or higher.

21. A method of mixing at least two materials, said method comprising:

providing a mixing apparatus comprising a cylindrical vessel having a diameter A and a lengthwise axis, said vessel comprising opposite first and second ends and having an inner wall, inlets for separately admitting at least two materials only to said first end of said vessel, and at least one outlet confined to said second end of said vessel for allowing materials to leave said vessel by way of said second end only, spaced obstacle means for presenting an annular outline when viewed in elevation along said lengthwise axis, said obstacle means being mounted on said inner wall of said vessel and presenting at the inner edge of said annular outline means for generating eddy flow, said means comprising sharp extremities at which two surfaces meet at a ridge, first means for connection to said inlets and for propelling materials through said vessel between said inlets and said at least one outlet in steady flow, and second means for imposing on said fluent material a component of oscillatory flow in addition to said steady flow, said second means being separate from and capable of executing oscillatory motion relative to said obstacle means, each said ridge of said obstacle means having a clear space lying between said ridge and said vessel lengthwise axis, said inner edge of said annular outline defining the periphery of a second of said clear space, said clear space being available for the flow of said fluent material through said vessel, said clear space having an area, when viewed along said lengthwise axis of said vessel, which substantially exceeds the area of said outline of said obstacle means when similarly veiwed;

introducing said at least two materials into said mixing apparatus via said inlets and withdrawing them mixed by way only of said at least one outlet; and superimposing a unidirectional motion through said vessel on said oscillatory motion, the Reynolds number of said steady flow being less than the peak Reynolds number of said oscillatory flow.

* * * * *